United States Patent [19]

Duggleby et al.

[11] 4,325,829

[45] Apr. 20, 1982

[54] DETERGENT COMPOSITIONS

[75] Inventors: Peter M. Duggleby, Wirral, England; Bernhard Kueter, Heidelberg, Fed. Rep. of Germany; Ronald M. Morris, Wirral, England; Horst Poeselt, Bensheim; Hermann Rabitsch, Mannheim, both of Fed. Rep. of Germany; Reginald V. Scowen, Wirral, England

[73] Assignee: Lever Brothers Company, New York, N.Y.

[21] Appl. No.: 205,128

[22] Filed: Nov. 10, 1980

[30] Foreign Application Priority Data

Nov. 12, 1979 [GB] United Kingdom ..... 39124/79

[51] Int. Cl.[3] ..... C11D 9/14

[52] U.S. Cl. ..... 252/109; 252/132; 252/135; 252/174.23

[58] Field of Search ..... 252/109, 135, 132, 174.23

[56] References Cited

FOREIGN PATENT DOCUMENTS 1530799 8/1976 United Kingdom .

*Primary Examiner*—Mayer Weinblatt

*Attorney, Agent, or Firm*—Melvin H. Kurtz

[57] ABSTRACT

A particulate detergent composition for fabric conditioning includes, in addition to a detergency active material, from 10–40% of a mixture of tripolyphosphate and orthophosphate in the ratio of 20:1 to 3:1 together with 2–25% of a mixture of soap and an anionic polyelectrolyte in the ratio of 10:1 to 1:1. Any pyrophosphate present must be kept below 5%. The soap and polyelectrolyte result in reduced deposition of inorganic materials onto the fabrics. The preferred polyelectrolyte is sodium polyacrylate with a molecular weight of about 27,000. The composition may also include conventional additional ingredients.

7 Claims, No Drawings

DETERGENT COMPOSITIONS

TECHNICAL FIELD

The invention concerns detergent compositions which are particularly adapted for fabric washing, and specifically with such compositions which are based on phosphate detergency builders. In particular the invention relates to compositions which have a mixed phosphate builder system capable of being effective at lower phosphorus levels in the compositions than has been customary.

BACKGROUND ART

It is known, for example from British Patent Specification No. 1,530,799, to use mixture of tripolyphosphate and orthophosphate in detergent compositions. In particular, these compositions may comprise from 5% to 30% of a synthetic anionic, nonionic, amphoteric or zwitterionic detergent compound or a mixture thereof, and from 10% to 30% of mixed alkali metal tripolyphosphate and alkali metal orthophosphate in the ratio of from 10:1 to 1:5 parts by weight, wherein the amount of alkali metal tripolyphosphate is at least 5%, and the amount of any alkali metal pyrophosphate is not more than 5%, all these percentages being by weight of the total detergent composition, and the pH of a 0.1% aqueous solution of the composition is from 9 to 11.

It is also known, for example from British Patent Specification No. 1,536,136, to incorporate polyelectrolytes such as substituted polyacrylic acids in detergent compositions for the purposes of lowering the amount of insoluble inorganic material which becomes deposited on the fabric during washing.

DISCLOSURE OF THE INVENTION

We have now discovered that in a composition containing tripolyphosphate and orthophosphate, optimum properties can be achieved by including in the composition a mixture of soap and a polyelectrolyte within certain proportions, provided that the level of pyrophosphate in the composition is below a prescribed level. Thus, according to the invention, there is provided a particulate detergent composition for fabric washing comprising from about 5% to about 40% by weight of at least one synthetic detergent compound, from about 10% to about 40% by weight of a mixture of alkali metal tripolyphosphate and alkali metal orthophosphate in the weight ratio of about 20:1 to about 3:1 characterised in that the composition contains from about 2% to about 25% by weight of a mixture of soap and an anionic polyelectrolyte in the weight ratio of from about 10:1 to about 1:1 and in that the composition contains, if any, not more than about 5% by weight alkali metal pyrophosphate.

The detergent compositions of the present invention are particularly beneficial in providing good detergency properties, especially at decreased phosphate builder levels. When phosphate builders are used at relatively low levels, especially in the absence of non-phosphate supplementary builders, there can be severe problems of inorganic deposition on the washed fabrics and the machine parts, due to the formation of insoluble phosphate salts. The present compositions have a decreased tendency to form such deposits due to the mixed antideposition agents employed and the optimisation of the alkali metal tripolyphosphate and orthophosphate builder mixtures. The overall result is therefore a product having a good general wash performance under modern wash conditions, but with a decreased phosphate potential.

BEST MODE OF CARRYING OUT INVENTION

The alkali metal orthophosphate used is either potassium or preferably sodium orthophosphate, as the latter is cheaper and more readily available. Normally the tri-alkali metal salts are used, but orthophosphoric acid or the di- or mono-alkali metal salts, eg disodium hydrogen orthophosphate or monosodium dihydrogen orthophosphate could be used if desired to form the compositions. In the latter event other more alkaline salts would also be present to maintain a high pH in the end product. The use of a mixture of the monosodium and disodium hydrogen orthophosphates in the ratio of 1:3 to 2:3, especially about 1:2, is particularly advantageous, as such a mixture is made as a feedstock for the production of sodium tripolyphosphate and is therefore readily available. Both the alkali metal orthophosphate and the sodium tripolyphosphate can be used initially as the anhydrous or hydrated salts, for example as trisodium orthophosphate dodecahydrate and pentasodium tripolyphosphate hexahydrate, but hydration normally takes place during detergent powder production. The amounts of the salts are, however, calculated in anhydrous form. The alkali metal tripolyphosphate used is either potassium or preferably sodium tripolyphosphate, the former being more expensive.

Whilst the ratio of the alkali metal tripolyphosphate to the alkali metal orthophosphate can be varied from about 20:1 to about 3:1 parts by weight, it is preferred to have a ratio of about 15:1 to about 5:1.

It will be appreciated that the actual amounts of alkali metal tripolyphosphate and alkali metal orthophosphate are chosen according to the overall phosphate detergency builder level which is desired in the detergent compositions or according to the maximum permitted phosphorus content. Within the requirements of a total alkali metal tripolyphosphate and alkali metal orthophosphate level of about 10% to about 40% by weight of the product, it is generally preferable to have an alkali metal tripolyphosphate content of from about 15% to about 30%, especially about 20% to about 25%, and an alkali metal orthophosphate content of from about 1% to about 10%, expecially about 2% to about 5%, by weight of the product. The total amount of alkali metal tripolyphosphate and alkali metal orthophosphate is preferably from about 15% to about 30% by weight of the composition. Preferably the total amount of all phosphate materials present in the detergent compositions is not more than about 30% by weight of the compositions.

It is preferable that the only phosphate detergency builders used to make the compositions of the invention should be the alkali metal tripolyphosphate and alkali metal orthophosphate. In particular, it is desirable to add no alkali metal, ie sodium or potassium, pyrophosphates to the compositions as they tend to increase inorganic deposition. However, low levels, ie up to about 5%, of sodium pyrophosphate may be found in spray dried powders due to the hydrolysis of sodium tripolyphosphate under the hot alkaline conditions met during conventional spray drying. To minimise the formation of alkali metal pyrophosphate by hydrolysis of the tripolyphosphate in spray drying, it is particularly preferred to postdose at least some of the tripolyphosphate to the detergent base powder made with the other ingredients, normally by spray drying. Such a process is described in our European patent application No. 79302057.9.

The detergent compositions of the invention necessarily include from about 5% to about 40%, preferably about 10% to about 25%, by weight of a synthetic anionic, nonionic, amphoteric or zwitterionic detergent compound or mixture thereof. Many suitable detergent compounds are commercially available and are fully described in the literature, for example in "Surface Active Agents and Detergents", Volumes I and II, by Schwartz, Perry and Berch.

The preferred detergent compounds which can be used are synthetic anionic and nonionic compounds. The former are usually water soluble alkali metal salts or organic sulphates and sulphonates having alkyl radicals containing from about 8 to about 22 carbon atoms, the term alkyl being used to include the alkyl portion of higher aryl radicals. Examples of suitable synthetic anionic detergent compounds are sodium and potassium alkyl sulphates, especially those obtained by sulphating higher ($C_8$–$C_{18}$) alcohols produced for example from tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid mono-glyceride sulphates and sulphonates; sodium and potassium salts of sulphuric acid esters of higher ($C_9$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphate and those derived by reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

Examples of suitable nonionic detergent compounds which may be used include in particular the reaction products of alkylene oxides, usually ethylene oxide, with alkyl ($C_6$–$C_{22}$) phenols, generally 5 to 25 EO, ie 5 to 25 units of ethylene oxide per molecule; the condensation products of aliphatic ($C_8$–$C_{18}$) primary or secondary linear or branched alcohols with ethylene oxide, generally 6 to 30 EO, and products made by condensation of ethylene oxide with the reaction products of propylene oxide and ethylene diamine. Other so-called nonionic detergent compounds include long chain tertiary amine oxides, long chain tertiary phosphine oxides and dialkyl sulphoxides.

Mixtures of detergent compounds, for example mixed anionic or mixed anionic and nonionic compounds may be used in the detergent compositions, particularly in the latter case to provide controlled low sudsing properties. This is beneficial for compositions intended for use in suds-intolerant automatic washing machines. The presence of some nonionic detergent compounds in the compositions may also help to decrease the tendency of insoluble phosphate salts to deposit on the washed fabrics.

Amounts of amphoteric or zwitterionic detergent compounds can also be used in the compositions of the invention but this is not normally desired due to their relatively high cost. If any amphoteric or zwitterionic detergent compounds are used it is generally in small amounts in compositions based on the much more commonly used synthetic anionic and/or nonionic detergent compounds. For example, mixtures of amine oxides and ethoxylated nonionic detergent compounds can be used.

The soap which is used as one of the mixed antideposition agents is the sodium, or less desirably potassium, salt of $C_{10}$–$C_{24}$ fatty acids. It is particularly preferred that the soap should be based mainly on the longer-chain fatty acids within this range, that is with at least half of the soap having a carbon chain length of 16 or over. This is most conveniently accomplished by using soaps from natural sources such as tallow, palm oil or rapeseed oil, which can be hardened if desired, with lesser amounts of other shorter-chain soaps, prepared from nut oils such as coconut oil or palm kernel oil. The amount of such soaps is generally in the range of from about 1% to about 20%, preferably about 2.5% to about 10%, especially about 3% to about 8% by weight of the composition. In addition to its antideposition effect, the soap also has a lather controlling action, for which purpose it is commonly employed in detergent compositions, and the soap can also have a beneficial effect on detergency by acting as a supplementary builder, especially when the compositions are used in hard water.

The other component of the mixed antideposition agents is an anionic polyelectrolyte, especially a linear poly-carboxylate or organic phosphonate, which have been proposed before decreasing inorganic deposits on washed fabrics. These materials appear to be effective by stabilising insoluble calcium orthophosphate particles in suspension. The anionic polyelectrolytes can readily be tested to determine their effectiveness as antideposition agents in a detergent composition by measuring the level of inorganic depositis on fabric washed with and without the anionic polyelectrolyte being present. The amount of these anionic polyelectrolytes is normally from about 0.1% to about 5% by weight, preferably from about 0.2% to about 2.5% by weight of the composition. The preferred polymeric linear poly-carboxylates are homo- and co-polymers of acrylic acid or substituted acrylic acids, such as sodium polyacrylate, the sodium salt of copolymethacrylamide/acrylic acid and sodium poly-alpha-hydroxyacrylate, salts of copolymers of maleic anhydride with ethylene, acrylic acid, vinylmethylether, allyl acetate or styrene, especially 1:1 copolymers and optionally with partial esterification of the carboxyl groups especially in the case of the styrene-maleic anhydride copolymers. Such copolymers preferably have relatively low molecular weights, eg in the range of about 5,000 to 50,000. Other such anionic polyelectrolytes include the sodium salts of polymaleic acid, polyitaconic acid and polyaspartic acid, phosphate esters of ethoxylated aliphatic alcohols, polyethylene glycol phosphate esters, and certain organic phosphonates such as sodium ethane-1-hydroxy-1, 1-diphosphonate, sodium 2-phosphonobutane tricarboxylate and sodium ethylene diamine tetramethylene phosphonate. Mixtures of organic phosphonic acids or substituted acrylic acids or their salts with protective colloids such as gelatine may also be used. The most preferred antideposition agent is sodium polyacrylate having a MW of about 10,000 to 50,000, for example about 27,000.

A particular benefit of using the mixed antideposition agents is that there are problems in using either alone at high enough levels to be as effective as desired. Specifically, amounts of soap above about 10% can cause processing problems which require special measures to add the soap after spray-drying the detergent base powder, and amounts of the anionic polyelectrolytes over about 2.5% in the compositions are in most cases discouraged because of their poor biodegradability and high cost. Thus, by using mixtures of both of these types of antideposition agents, it is possible to achieve excellent ash control in a technically feasible and economical manner.

Within the limits and relative proportions quoted above it is particularly preferred if the total amount of orthophosphate, soap and anionic polyelectrolyte is between about 5.0% and about 10.0% by weight.

Apart from the detergent compounds, detergency builders and mixed antideposition agents, the detergent compositions of the invention can contain any of the conventional additives in the amounts in which such materials are normally employed in fabric washing detergent compositions. Examples of these additives include lather boosters such as alkanolamides, particularly the monoethanolamides derived from palm kernel fatty acids and coconut fatty acids, lather depressants such as alkyl phosphates, silicones and waxes, antiredeposition agents such as sodium carboxymethulcellulose and polyvinyl pyrrolidone, peroxygen bleach compounds eg sodium perborate and activators therefore such as tetraacetylethylene diamine, stabilisers for the activators in bleach systems such as ethylene diamine tetramethyl phosphonic acid, fabric softening agents, inorganic salts such as sodium sulphate and sodium carbonate, chlorine bleach compounds and, usually present in very minor amounts, fluorescent agents, perfumes, enzymes such as proteases and amylases, germicides and colourants.

It is also possible to include in the detergent compositions of the invention minor amounts, preferably not more than about 20% by weight, of other non-phosphate detergency builders, which may be either so-called precipitant builders or sequesterant builders. This is of particular benefit where it is desired to increase detergency whilst using particularly low levels of the essential alkali metal tripolyphosphate and alkali metal orthophosphate builders, so as to achieve low phosphorus contents in the detergent compositions. Examples of such other detergency builders are amine carboxylates such as sodium nitrilotriacetate, crystalline or amorphous sodium aluminosilicate ion-exchange materials, sodium alkenyl succinates and malonates, sodium carboxymethyl oxysuccinate, sodium citrate, which can function as a detergency builder as discussed above. However, such other builder materials are not essential and it is a particular benefit of the compositions of the invention that satisfactory detergency building properties can be achieved with only phosphate builders at lower levels than hitherto considered necessary.

It is also desirable to include in the compositions an amount of an alkali metal silicate, particularly sodium ortho-, meta- or preferably neutral or alkaline silicate. The presence of such alkali metal silicates at levels of at least about 1%, and preferably from about 5% to about 15% by weight of the compositions, is advantageous in decreasing the corrosion of metal parts in washing machines, besides giving processing benefits and generally improved powder properties. The more highly alkaline ortho- and meta-silicates would normally only be used at lower amounts within this range, in admixture with the neutral or alkaline silicates.

The compositions of the invention are required to be alkaline, but not too strongly alkaline as this could result in fabric damage and also be hazardous for domestic usage. In practice the compositions should give a pH of from about 8.5 to about 11 in use in aqueous wash solution. It is preferred in particular for domestic products to have a pH of from about 9.0 to about 10.5, as lower pHs tend to be less effective for optimum detergency building, and more highly alkaline products can be hazardous if misused. The pH is measured at the lowest normal usage concentration of 0.1% w/v of the product in water of 12° H.(Ca), (French permanent hardness, calcium only) at 50° C. so that a satisfactory degree of alkalinity can be assured in use at all normal product concentrations.

The pH is controlled by the amount of alkali metal orthophosphate and any other alkaline salts such as alkali metal silicate, sodium perborate and sodium carbonate, the amount of the latter preferably being not more than 20% by weight of the composition. The presence of other alkaline salts, especially the alkali metal silicates, is particularly beneficial because the alkalinity of the alkali metal orthophosphate is diminished in hard water due to precipitation of the calcium salt. The other ingredients in the alkaline detergent compositions of the invention should of course be chosen for alkaline stability, especially for pH-sensitive materials such as enzymes.

The detergent compositions of the invention should be in free-flowing particulate, eg powdered or granular form, and can be produced by any of the techniques commonly employed in the manufacture of such fabric washing compositions, but preferably by slurry making and spray drying processes to form a detergent base powder to which the ingredients of the bleach system, and optionally also the alkali metal tripolyphosphate are added. It is preferred that the process used to form the compositions should result in a product having a moisture content of not more than about 12%, more preferably from about 4% to about 10% by weight.

The compositions of the invention are illustrated by the following Examples in which parts and percentages are by weight, and amounts are expressed on an anhydrous basis except where otherwise indicated.

EXAMPLE 1

A series of detergent compositions were prepared by making a detergent base powder and then adding to it amounts of extra soap and sodium polyacrylate (MW 27000) as indicated below:

| Base powder ingredients | % |
|---|---|
| Sodium alkyl benzene sulphonate | 6 |
| Nonionic compounds ($C_{12}$-12 EO and 18 EO) | 2 |
| Soap (predominantly $C_{16}$–$C_{22}$) | 3 |
| Sodium alkaline silicate | 5.4 |
| Sodium tripolyphosphate[1] | 23 |
| Sodium orthophosphate | 2 |
| SCMC | 1.0 |
| Sodium perborate[2] | 22 |
| Sodium sulphate | 26.3 |

-continued

| Base powder ingredients | % |
|---|---|
| Water, minor ingredients and additives to | 100 |

[1]About 3.5% of the sodium tripolyphosphate was hydrolysed during processing with a corresponding increase in the orthophosphate level of about 0.5% and the formation of about 3% sodium pyrophosphate.
[2]postdosed to the base powder

| Additives | 1 | 2 | 3 | 4 | 5 |
|---|---|---|---|---|---|
| Soap[1] | — | — | — | 2 | 2 |
| Sodium polyacrylate | — | 1 | 2 | — | 1 |
| Total content of orthophosphate, soap and polyacrylate (approx) | 5.5 | 6.5 | 7.5 | 7.5 | 8.5 |

[1]Amount in addition to the 3% in the base powder.

These compositions were tested for inorganic deposition on fabrics washed in an automatic inorganic deposition on fabrics washed in an automatic washing machine on the boil cycle in water of 40° FH. at a product dosage of 138 gms prewash and 138 gms main wash. The results were as follows:

| % ash (average figure on combed cotton and terry towelling) | | | | | |
|---|---|---|---|---|---|
| Wash cycles | Test 1 | Test 2 | Test 3 | Test 4 | Test 5 |
| 1 | 0.43 | 0.29 | 0.30 | 0.33 | 0.32 |
| 3 | 0.56 | 0.48 | 0.29 | 0.52 | 0.35 |
| 5 | 0.83 | 0.54 | 0.61 | 0.51 | 0.49 |
| 10 | 1.96 | 0.55 | 1.06 | 1.58 | 1.01 |
| 15 | 3.20 | 2.44 | 1.55 | 2.95 | 2.06 |
| 20 | 6.09 | 4.00 | 2.27 | 4.54 | 3.40 |

Comparison of the results shows the benefit of using the mixed soap and sodium polyacrylate as antideposition agents in formulations 2, 3 and 5.

These results were further confirmed by Launderometer testing of a similar formulation which contained 7% of soap and 1% of the sodium polyacrylate. The levels of inorganic deposits were determined after 10 wash cycles on cotton poplin and Krefeld cotton samples at product dosages of 10 g/l and 12 g/l at 95° C. in water of 23° German Hardness. For both samples and for both product dosages, the levels of inorganic deposits were found to be only about 0.2% by weight.

EXAMPLE 2

Four compositions identified as A, B, C and D in the following table were prepared by forming a slurry of some of the components, spray drying the slurry to form a spray-dried base powder and subsequently adding the remaining ingredients. The compositions were used to wash fabrics, including monitors in a Siemens WA 4600 top loader washing machine at 95° C. The water hardness was 17° (German). A product dosage of 100 g pre-wash, 100 g main wash was used in about 18 liters water.

The percentage of ash found on the test monitors was determined. The results are set out in the following table.

-continued

| SAMPLE: | A | B | C | D |
|---|---|---|---|---|
| Spray dried ingredients (%) | | | | |
| Anionic detergent active | 6.5 | 6.5 | 6.5 | 6.5 |
| Nonionic detergent active | 3.0 | 3.0 | 3.0 | 3.0 |
| Sodium tripolyphosphate | 11.0 | 11.0 | 11.0 | 11.0 |
| Trisodium orthophosphate | 2.0 | 2.0 | 2.0 | 2.0 |
| Soap (predominantly $C_{16}$–$C_{22}$) | 5.0 | 5.0 | 5.0 | 5.0 |
| Sodium polyacrylate | — | 1.0 | — | 1.0 |
| Post-dosed ingredients (%) | | | | |
| Sodium tripolyphosphate | 12.0 | 12.0 | 12.0 | 12.0 |
| Sodium perborate | 20.0 | 20.0 | 20.0 | 20.0 |
| TAED | 2.0 | 2.0 | 2.0 | 2.0 |
| Soap (82/18 tallow/coco Na) | — | — | 2.0 | 2.0 |
| Water and minor ingredients | | balance to 100 | | |
| Ash (%) | | | | |
| 5 washes | 0.3 | 0.3 | 0.4 | 0.2 |
| 10 washes | 0.8 | 0.3 | 1.0 | 0.3 |
| 15 washes | 1.7 | 0.6 | 1.3 | 0.3 |
| 20 washes | 3.1 | 0.7 | 2.5 | 0.5 |

We claim:

1. A particulate alkaline detergent composition for fabric washing consisting essentially of about 5% to about 40% by weight of at least one synthetic detergent compound, and about 10% to about 40% by weight of a mixture of alkali metal tripolyphosphate and alkali metal orthophosphate in the weight ratio of about 20:1 to about 3:1, wherein the composition contains about 2% to about 25% by weight of a mixture of soap and an anionic polyelectrolyte selected from linear polycarboxylates and organic phosponates in the weight ratio of about 10:1 to about 1:1 and nor more than, if any, about 5% by weight of alkali metal pyrophosphate.

2. A composition according to claim 1 wherein the soap is present in an amount of about 1% to about 20% by weight of the composition.

3. A composition according to claim 1 wherein the anionic polyelectrolyte is present in an amount of about 0.1% to about 5% by weight of the composition.

4. A composition according to claim 1 wherein the total content of the orthophosphate, soap and anionic polyelectrolyte is about 5.0% and about 10.0% by weight.

5. A composition according to claim 1 wherein the composition further comprises not more than about 12% by weight of water.

6. A method of forming a particulate, alkaline, detergent composition, consisting essentially the steps of mixing together at least one synthetic detergent compound, an alkali metal tripolyphosphate, an alkali metal orthophosphate, soap and an anionic polyelectrolyte in such quantities so as to produce a composition having about 5% to about 40% by weight of the synthetic detergent compound, about 10% to about 40% by weight in total of the tripolyphosphate and the orthophosphate in the weight ratio of about 20:1 to about 3:1 and about 2% to about 25% by weight in total of the soap and the polyelectrolyte in the ratio of about 10:1 to about 1:1, the composition being so formed that it contains, if any, not more than about 5% by weight of alkali metal pyrophosphate.

7. A method according to claim 6 further consisting essentially the steps of (i) forming a slurry containing at least the detergent compound, the orthophosphate, the soap and the polyelectrolyte;

(ii) spray drying the slurry formed in step (i) to form a base powder; and (iii) subsequently mixing the tripolyphosphate with the base powder formed in step (ii).

* * * * *